US008918943B2

(12) United States Patent
Blaszczec

(10) Patent No.: US 8,918,943 B2
(45) Date of Patent: Dec. 30, 2014

(54) APPARATUS FOR CLEANING GOLF CLUBS

(76) Inventor: Miroslaw Blaszczec, Lindenhurst, NY (US)

( * ) Notice: Subject to any disclaimer, the term of this patent is extended or adjusted under 35 U.S.C. 154(b) by 242 days.

(21) Appl. No.: 13/413,612

(22) Filed: Mar. 6, 2012

(65) Prior Publication Data

US 2012/0227198 A1 Sep. 13, 2012

Related U.S. Application Data

(60) Provisional application No. 61/450,160, filed on Mar. 8, 2011.

(51) Int. Cl.

| | |
|---|---|
| ***A47L 13/12*** | (2006.01) |
| ***A47L 9/02*** | (2006.01) |
| ***A46B 5/00*** | (2006.01) |
| *A63B 57/00* | (2006.01) |

(52) U.S. Cl.

CPC ..... *A46B 5/0012* (2013.01); *A63B 57/0087* (2013.01); *A46B 2200/3073* (2013.01)

USPC ..... 15/160; 15/227

(58) Field of Classification Search

CPC ..... A46B 15/00; A46B 9/02; A63B 57/0087

USPC ..... 15/160, 227; 2/16, 160

See application file for complete search history.

(56) References Cited

U.S. PATENT DOCUMENTS

| | | | | |
|---|---|---|---|---|
| 590,347 | A * | 9/1897 | Sylvestre | 2/20 |
| 4,734,953 | A | 4/1988 | Dodson | |
| 4,971,126 | A | 11/1990 | Borenstein | |
| 5,322,105 | A | 6/1994 | Meek | |
| D350,232 | S * | 9/1994 | Stangarone et al. | D4/116 |
| 5,615,720 | A | 4/1997 | O'Sullivan | |
| D386,847 | S | 11/1997 | Petrie | |
| 5,878,460 | A | 3/1999 | Bruce | |
| 6,302,269 | B1 * | 10/2001 | Risch | 206/362.3 |
| 6,733,016 | B2 | 5/2004 | Chung | |
| 7,117,536 | B2 * | 10/2006 | Burnett et al. | 2/16 |
| D547,010 | S | 7/2007 | Shamoon | |
| 7,302,728 | B2 | 12/2007 | Kunz | |
| D575,460 | S | 8/2008 | Patel | |
| 7,484,262 | B2 | 2/2009 | Cotton | |

* cited by examiner

*Primary Examiner* — Shay Karls

(74) *Attorney, Agent, or Firm* — Gerald E. Hespos; Michael J. Porco; Matthew T. Hespos

(57) ABSTRACT

An apparatus for cleaning golf clubs is provided. The apparatus includes a substantially symmetrical body having a first pocket opposite a second pocket for accepting fingers or a thumb of a user. The first and second pockets are flexibly coupled by a hinge portion and define a first opening for receiving a head of a golf club. A second opening is defined by the opening ends of the first and second pockets and is configured for receiving a hand of the user. The first and second pocket have opposing exterior walls which can be brought into contact with a golf club head to clean same. At least one of the opposing exterior walls will include an abrasive surface, e.g., bristles, for cleaning a surface of the golf club head. In other embodiments, both opposing exterior walls will include abrasive surfaces to facilitate cleaning of the golf club head.

11 Claims, 7 Drawing Sheets

APPARATUS FOR CLEANING GOLF CLUBS

PRIORITY

This application claims priority on U.S. Provisional Patent Appl. No. 61/450,160, filed Mar. 8, 2011, entitled "APPARATUS FOR CLEANING GOLF CLUBS", the content of which is hereby incorporated by reference in its entirety.

BACKGROUND

1. Field

The present disclosure relates generally to sports and golf accessories, and more particularly, an apparatus for cleaning golf clubs.

2. Description of the Related Art

A typical golf course is usually watered at least once a day and sometimes more often during the intense heat of summer. When a round is played, the golfer usually uses his irons more than the driving clubs. All clubs except the putter have grooves cut along the hitting face of the club head to impart spin to the ball when struck.

The spin is advantageous for directional control of the ball. A skilled player can shape the curve of a golf shot to avoid a hazard and then curve back the ball toward the pin. Spin also aids in controlling the distance the ball flies. So it is important that the grooves of the club head be kept free of dirt and debris.

Dirt is typically picked up and embedded in the grooves of the club head. When an iron shot is struck correctly, the top portion of the ground is shaved off creating a divot. The courteous golfer replaces the shaved portion of sod in the hole just created but then has to deal with the mess he's just made of the club face. Normally the golfer uses a combination of tools to clean the face—a stiff brush and a towel. The brush is used to remove dirt, sand, grass etc., from the grooves and the towel is then used to clean the flat portion of the face. Since the ground may be wet from watering (or after a rain shower), the towel also clears off any moisture that may cling to the surface of the golf club head.

Usually after a few such cleanings, the towel begins to retain both moisture and dirt from the previous cleanings. On wet days, the towel becomes saturated very quickly and it becomes difficult for the golfer to keep his hands dry. The towel will also impart some of the moisture to the glove the golfer wears. Moisture may also get transferred to the club grips, making the holding of the club during striking difficult. Golfers have been known to lose their grip entirely, sometimes throwing the club farther than the ball.

Therefore, a need exists for techniques to permit a golfer to clean golf clubs thoroughly without the drawbacks described above.

SUMMARY

An apparatus for cleaning golf clubs is provided. The apparatus consists of a flexible, silicone (or similar waterproof material) molded hand tool. The tool resembles a pair of oven mitts connected together across one side of the opening for the hands. One side of the tool has a set of bristle brushes arranged in rows across the small bias of the inner face. The other side is smooth, though it may have a set of ridges or small bumps molded into it to improve the grip. The bristles are preferably attached to the mitt during a molding process.

In one aspect of the present disclosure, the apparatus includes a substantially symmetrical V-shaped body having a first pocket opposite a second pocket for accepting fingers or a thumb of a user. The first and second pockets are flexibly coupled by a hinge portion and define a first opening for receiving a head of a golf club. A second opening is defined by the opening ends of the first and second pockets and is configured for receiving a hand of the user. The first and second pocket have opposing exterior walls which can be brought into contact with a golf club head to clean same. At least one of the opposing exterior walls will include an abrasive surface, e.g., bristles, for cleaning a surface of the golf club head. In other embodiments, both opposing exterior walls of the first and second pockets will include abrasive surfaces to facilitate cleaning of the golf club head.

Both halves, or pockets, of the apparatus are molded about a symmetrical axis so that either a left or right handed golfer may use it. The golfer inserts his fingers into the side of the mitt, i.e., one of the first or second pockets, with the brushes and his thumb into the other half of the tool. To clean the club, the user creates a "'V" shape into which he inserts the club head with the face oriented towards the half with the brushes or other abrasive surface. The golfer then rubs the club face until all dirt and debris have been eliminated. Due to the flexible nature of the tool or apparatus, the golfer can vary the force applied to the club head, e.g., by squeezing, to clean the golf club surface.

BRIEF DESCRIPTION OF THE DRAWINGS

The above and other aspects, features, and advantages of the present disclosure will become more apparent in light of the following detailed description when taken in conjunction with the accompanying drawings in which.

DETAILED DESCRIPTION

Figure 1:
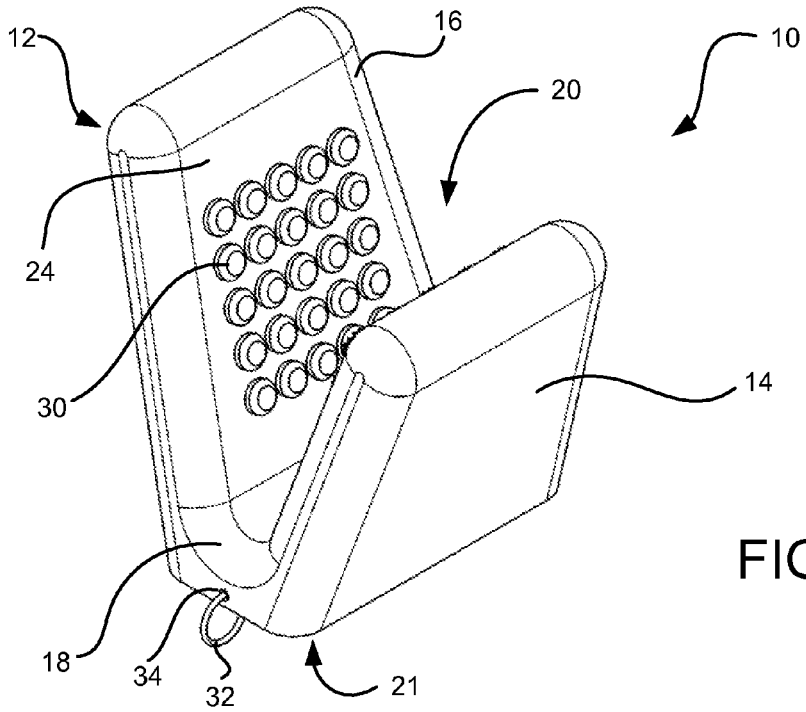
FIG. 1 is a perspective view of an apparatus for cleaning golf clubs in accordance with an embodiment of the present disclosure.
Figure 2:
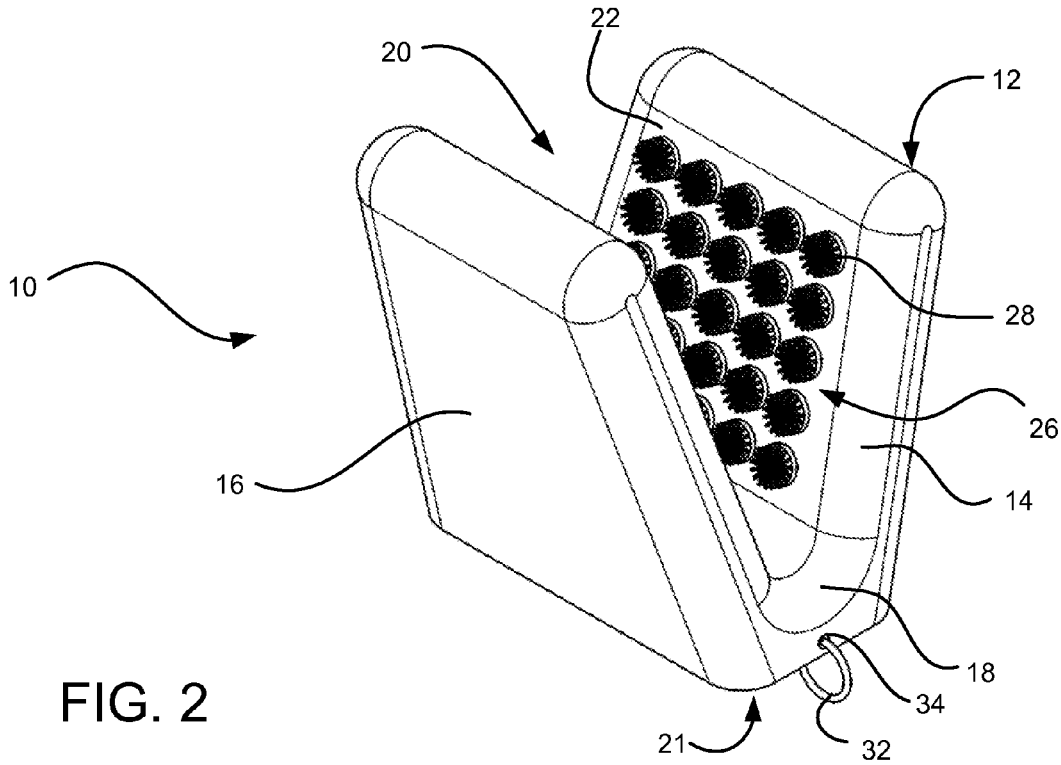
FIG. 2 is another perspective view of an apparatus for cleaning golf clubs in accordance with an embodiment of the present disclosure.
Figure 3A:
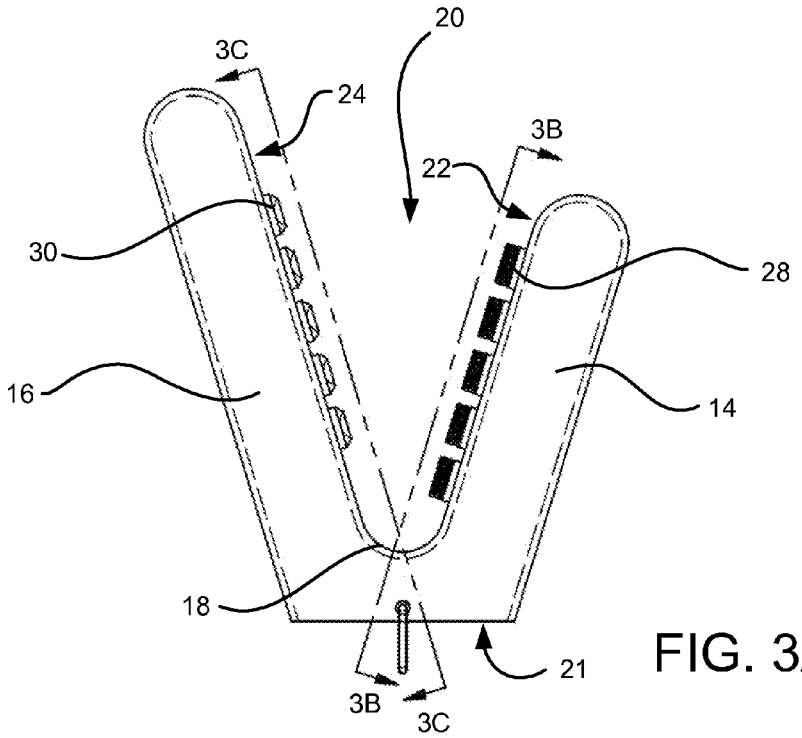
FIG. 3A is a side view of an apparatus for cleaning golf clubs in accordance with an embodiment of the present disclosure.
Figure 3B:
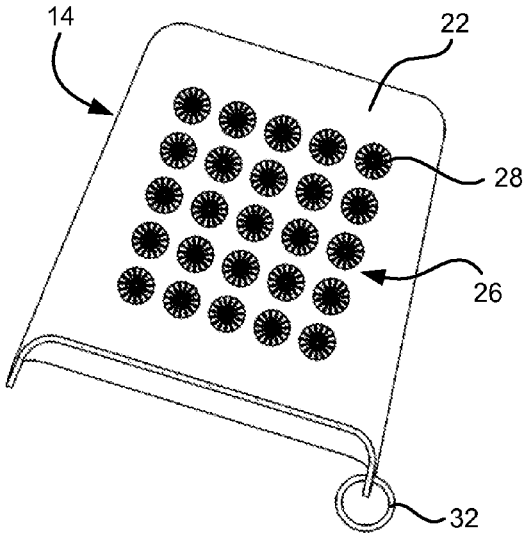
FIG. 3B is a sectional view of the apparatus shown in FIG. 3A taken along line 3B-3B.
Figure 3C:
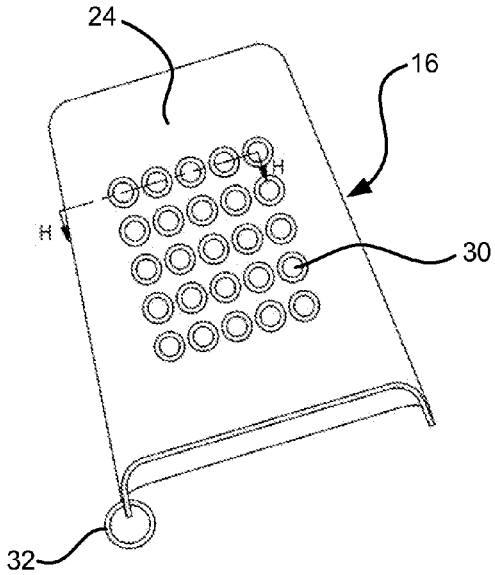
FIG. 3C is a sectional view of the apparatus shown in FIG. 3A taken along line 3C-3C.
Figure 4:
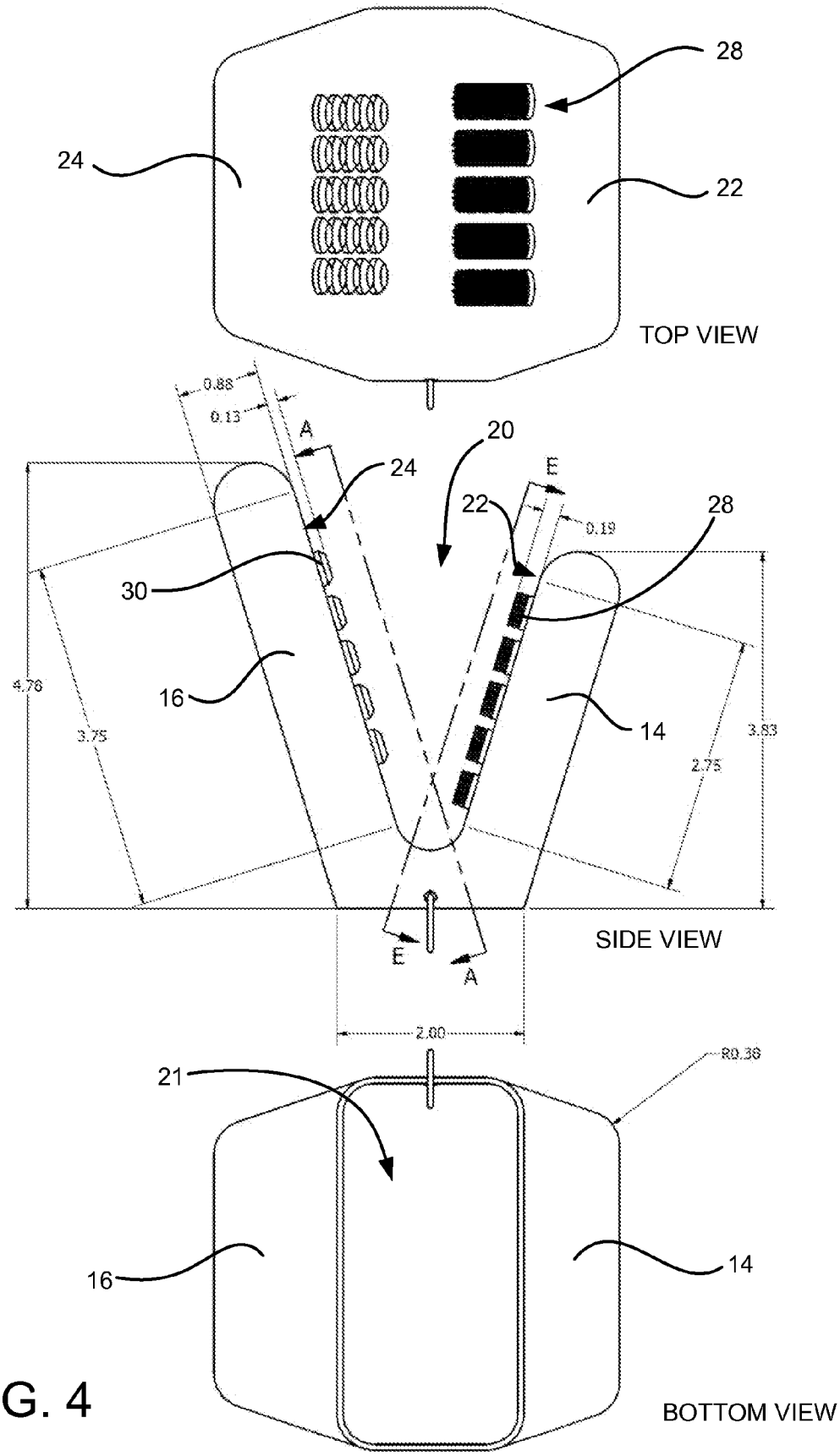
FIG. 4 illustrates a top view, side view and bottom view of an apparatus for cleaning golf clubs in accordance with an embodiment of the present disclosure.

Preferred embodiments of the present disclosure will be described hereinbelow with reference to the accompanying drawings. In the following description, well-known functions or constructions are not described in detail to avoid obscuring the present disclosure in unnecessary detail.

Referring to the FIGS. 1-5, an apparatus 10 for cleaning golf clubs is illustrated. The apparatus 10 includes a substantially symmetrical V-shaped body 12 having a first pocket 14 opposite a second pocket 16 for accepting fingers or a thumb of a user. The first and second pockets 14, 16 are flexibly coupled by a hinge portion 18 and define a first opening 20 for receiving a head of a golf club. A second opening 21 is defined by the opening ends of the first and second pockets 14, 16 and is configured for receiving a hand of the user.

The apparatus 10 is made from a flexible material to allow the first and second pockets 14, 16 to be moved towards each other to thereby hold the head of the golf club within the opening 20. Due to its flexible nature, the opening 20 can be manipulated by the user to accommodate different sizes and shapes of golf club heads. The apparatus 10 is preferably molded as a unitary piece of silicone but other flexible and/or waterproof materials are contemplated to be within the scope of the teachings of the present disclosure.

The first pocket 14 includes a first exterior wall 22 which faces inward toward opening 20 and the second pocket 16. The second pocket 16 includes a second exterior wall 24 which faces inward toward opening 20 and the first pocket 14. Exterior wall 22 of the first pocket 14 includes a plurality of bristles 26 which include individual circular bristle portions 28. In this embodiment, each bristle portion 28 include a plurality of individual strands of bristles. The individual strands may be rigid or deformable to enter and clean the grooves of a golf club head as will be described below. The individual circular bristle portions 28 may be directly fixed or coupled to wall 22 individually or may be fixed to a substrate which is then coupled to exterior wall 22 by a conventional adhering process. The plurality of bristles 26 are employed by the apparatus 10 to remove debris from the grooves of the head of the golf club. Although a plurality of bristles 26 are shown in the Figures, other abrasive materials or surfaces (e.g., brushes) are contemplated to be within the scope of the teachings of the present disclosure.

Exterior wall 24 of the second pocket 16 includes a plurality of protrusions 30. The plurality of protrusions 30 may be fixed to wall 24 individually or may be fixed to a substrate which is then coupled to exterior wall 24 by a conventional adhering process. The plurality of protrusions 30 are employed by the apparatus 10 to remove large pieces of debris from the head of the golf club, for example, chunks of dirt, pieces of sod, etc. In one embodiment, the protrusions 30 are configured to be rigid, although deformable protrusions are contemplated by the present disclosure. Although a plurality of protrusions 30 are shown in the Figures, other abrasive materials or surfaces are contemplated to be within the scope of the teachings of the present disclosure. For example, bristles 28 may be applied to both exterior wall 22 and exterior wall 24. Furthermore, the exterior wall 24 of the second pocket 16 may be smooth and not include any protrusions.

It is to be appreciated that the protrusions 30 may take a variety of shapes and/or forms. In FIGS. 1-5, the protrusions 30 are illustrated as semi-spherical in shape but can be cylindrical, pyramidal, square, rectangular, etc. This listing is in no way meant to be exhaustive but is provided to show that the protrusions can take many shapes and be within the teachings and scope of the present disclosure.

In another embodiment, the exterior walls 22, 24 may be provided with an exchangeable component. For example, the plurality of bristles 28 may be provided on a substrate which can be removed and replaced with a different substrate that may have a different abrasive surface or different size bristles disposed thereon to accommodate different tasks. Likewise, the protrusions 30 may be provided on a removable substrate which can be replaced with other components. This embodiment will facilitate replacing of the plurality of bristles 26 when the original bristles are worn.

Preferably, a ring 32 is coupled to the hinge portion 18 via an aperture 34 allowing the apparatus 10 to be attached to a belt of the user or a golf bag with the use of a clip (not shown). In addition, a flexible cord may be used between the ring 32 of the apparatus 10 and the clip so that it need not be detached from the belt of the user or the golf bag for use.

Figure 5:
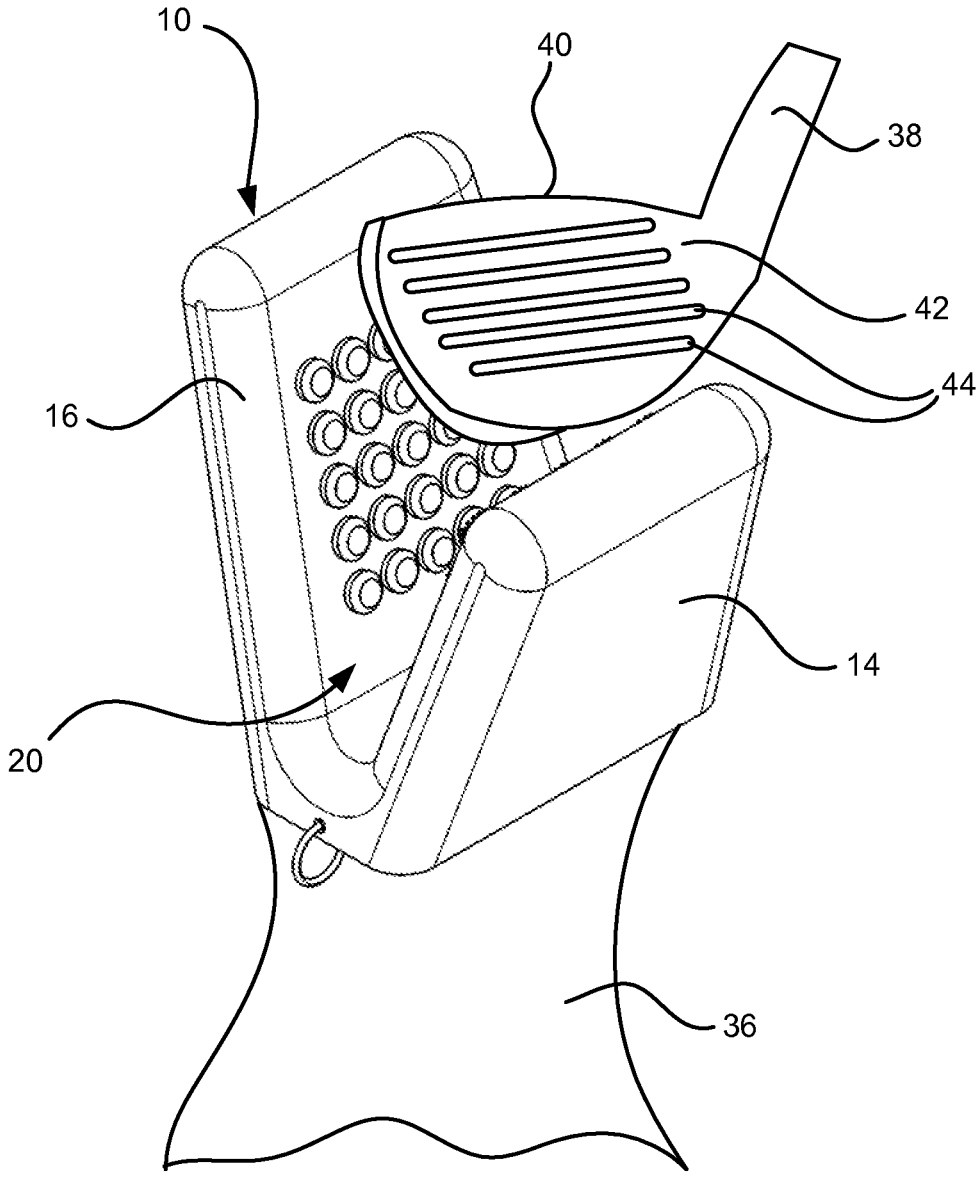
FIG. 5 is a perspective view of the apparatus on a hand of a user, where the apparatus is receiving a head of a golf club.
Figure 6:
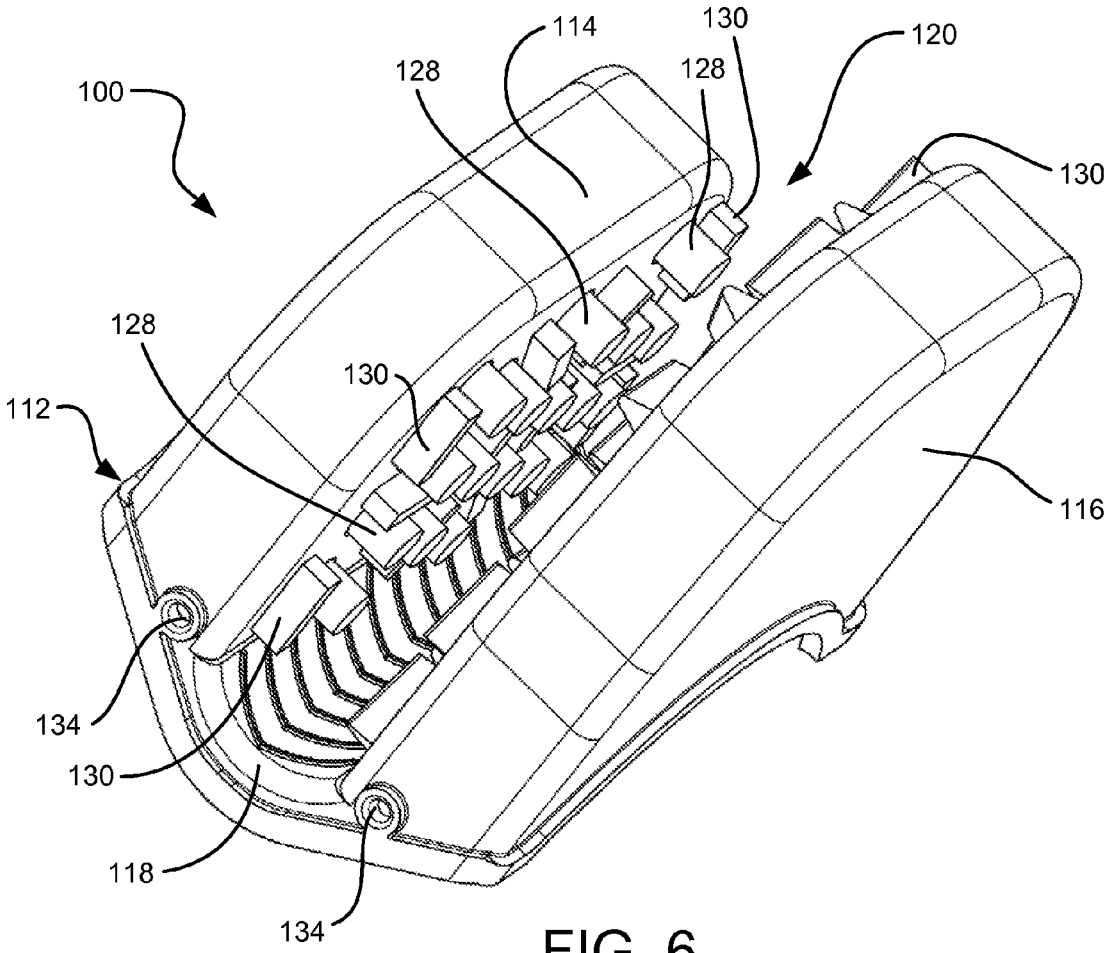
FIG. 6 is a perspective view of an apparatus for cleaning golf clubs in accordance with another embodiment of the present disclosure.

In use, a user, e.g., a golfer, places the apparatus 10 on their hand 36 as shown in FIG. 5. The golfer inserts his fingers into the first pocket 14 with the bristles or brushes and his thumb into the second pocket 16 of the apparatus 10. It is to be appreciated that both halves or pockets of the apparatus 10 are configured or molded in a similar shape so that either a left or right handed golfer may use the apparatus.

To clean a golf club 38, the user creates a "V" shaped opening 20 into which the user inserts the club head 40 with the face 42 oriented towards the wall 22 of the first pocket 14 with the plurality of bristles 28. As can be seen in FIG. 5, the club head 40 includes a plurality of grooves 44 disposed on the face 42. In one embodiment, the user urges the rigid protrusions 30 against the surfaces of the golf club 38 to remove any large pieces of debris such as chucks of dirt, sod, etc. Next, the user urges the plurality of bristles 26 against the face 42 of the club 38 to urge the bristles into the grooves 44 of the club 38 to remove any debris in the grooves 44. The golfer then rubs the club face 42 until all dirt and debris have been eliminated from the grooves 44.

Since the apparatus 10 is made from waterproof silicone, the user's hand remains dry throughout the process eliminating one of the main problems with the separate towel and brush method. The silicone tool is flexible and allows any type of iron club to be cleaned, including the new bulky shaped hybrid clubs.

Because the apparatus 10 is used within the hand 36, more pressure can be exerted on the club face 42 to clean it then when using a separate brush. This makes the cleaning process quicker and more thorough than when using the conventional method. The silicone material also improves the hold on the club 38 which may be slippery from wet grass.

When wiping the club with a towel, the golfer may choose to keep his hand inside the apparatus 10 protecting his hand from the moisture the towel has already collected. Once he is done, he can remove the apparatus 10 from his hand.

Referring to the FIGS. 6-11, an apparatus 100 for cleaning golf clubs is illustrated in accordance with another embodiment of the present disclosure. The apparatus 100 includes a substantially symmetrical U-shaped body 112 having a first pocket 114 opposite a second pocket 116 for accepting fingers or a thumb of a user. The first and second pockets 114, 116 are flexibly coupled by a hinge portion 118 and define a first opening 120 for receiving a head of a golf club. A second opening 121 is defined by the opening ends of the first and second pockets 114, 116 and is configured for receiving a hand of the user.

As described above, the apparatus 100 is made from a flexible material to allow the first and second pockets 114, 116 to be moved towards each other to thereby hold the head of the golf club within the opening 120. The apparatus 100 is preferably molded as a unitary piece of silicone but other flexible and/or waterproof materials are contemplated to be within the scope of the teachings of the present disclosure. Furthermore, the apparatus includes a plurality of apertures 134 to facilitate tethering the apparatus 100 to the user or a golf bag via a chain, cable, cord or the like. In the embodiment shown, the apparatus 100 includes at least two apertures on either side of the body 112 but more or less apertures may be provided.

The first pocket 114 includes a first exterior wall 122 which faces inward toward opening 120 and the second pocket 116. The second pocket 116 includes a second exterior wall 124 which faces inward toward opening 120 and the first pocket 114. In the embodiment shown, both exterior walls 122, 124 include a plurality of protrusions 130. The plurality of protrusions 130 may be fixed to walls 122, 124 individually or may be fixed to a substrate which is then coupled to exterior walls 122, 124 by a conventional adhering process. The plurality of protrusions 130 are employed by the apparatus 10 to remove large pieces of debris from the head of the golf club, for example, chucks of dirt, pieces of sod, etc. In one embodiment, the protrusions 130 are configured to be rigid, although deformable protrusions are contemplated by the present disclosure. It is to be appreciated that the protrusions 30 may take a variety of shapes and/or forms. In one embodiment, the protrusions 130 on the first exterior wall 122 and the second exterior wall 124 are of substantially the same height, while in other embodiments, the protrusions are of differing heights.

In FIGS. 6-11, the protrusions 130 are illustrated as prism-shaped but can be cylindrical, pyramidal, square, rectangular, etc. This listing is in no way meant to be exhaustive but is provided to show that the protrusions can take many shapes and be within the teachings and scope of the present disclosure.

Figure 7:
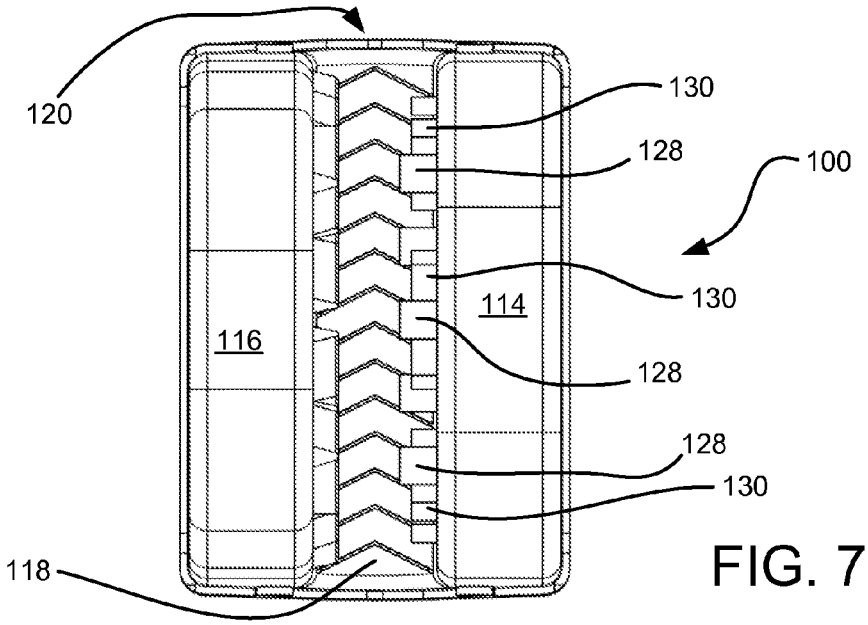
FIG. 7 is a top view of the apparatus shown in FIG. 6.
Figure 8:
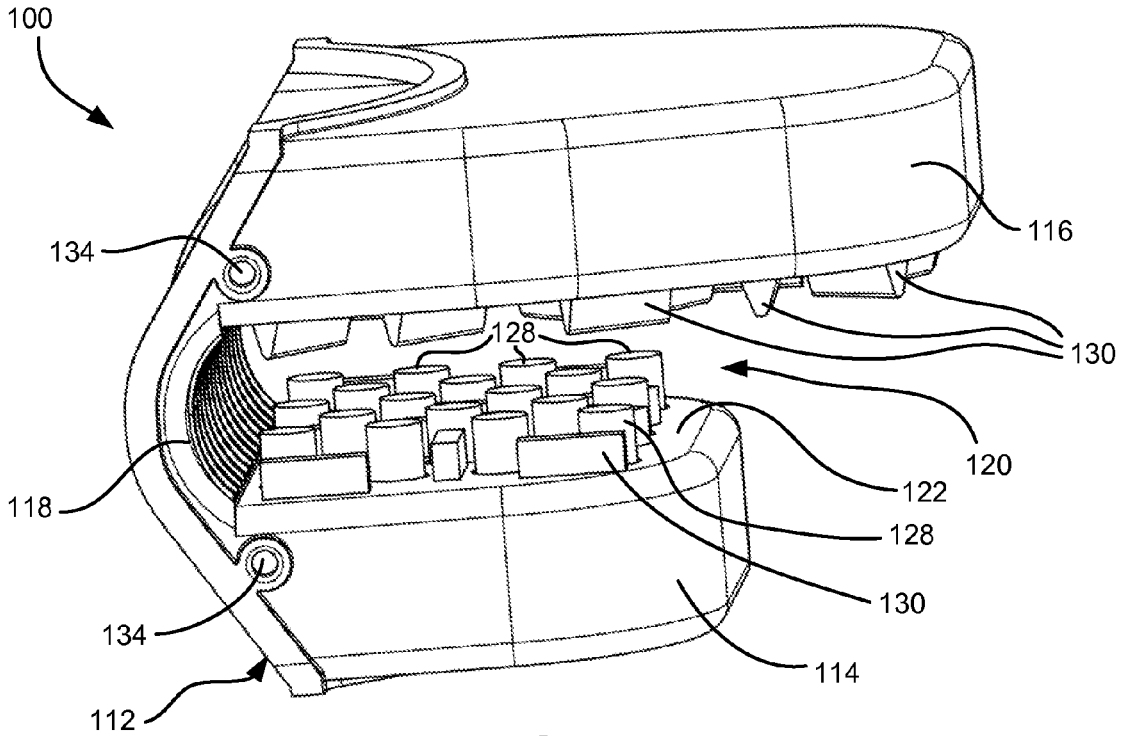
FIGS. 8-9 are perspective side views of the apparatus shown in FIG. 6.
Figure 9:
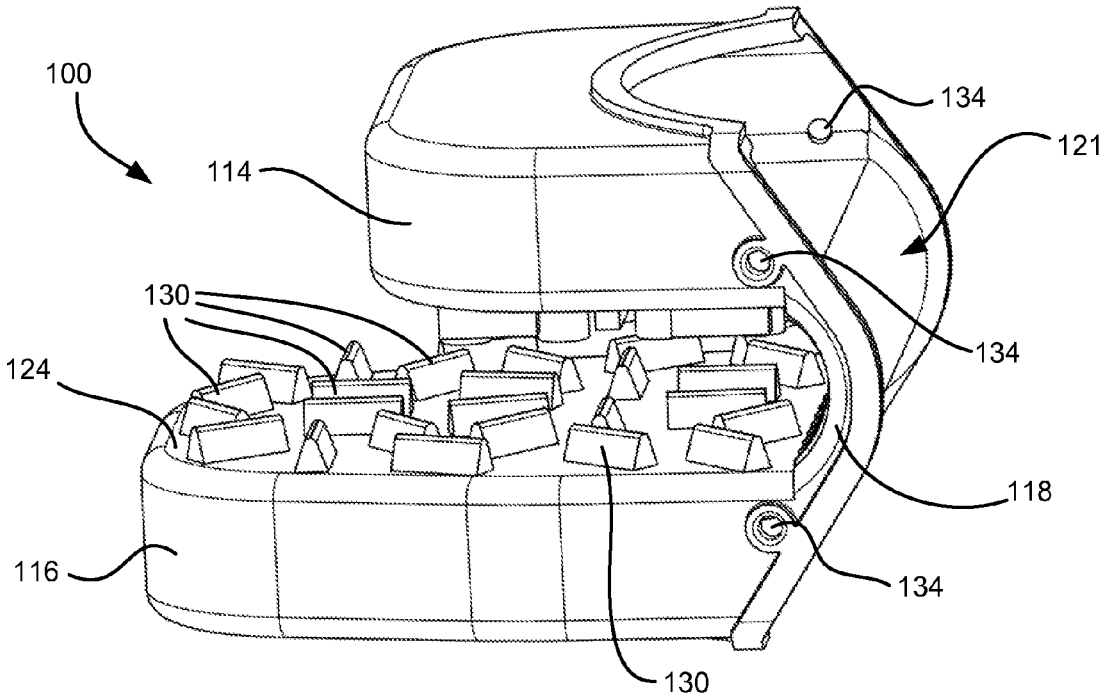
Figure 10:
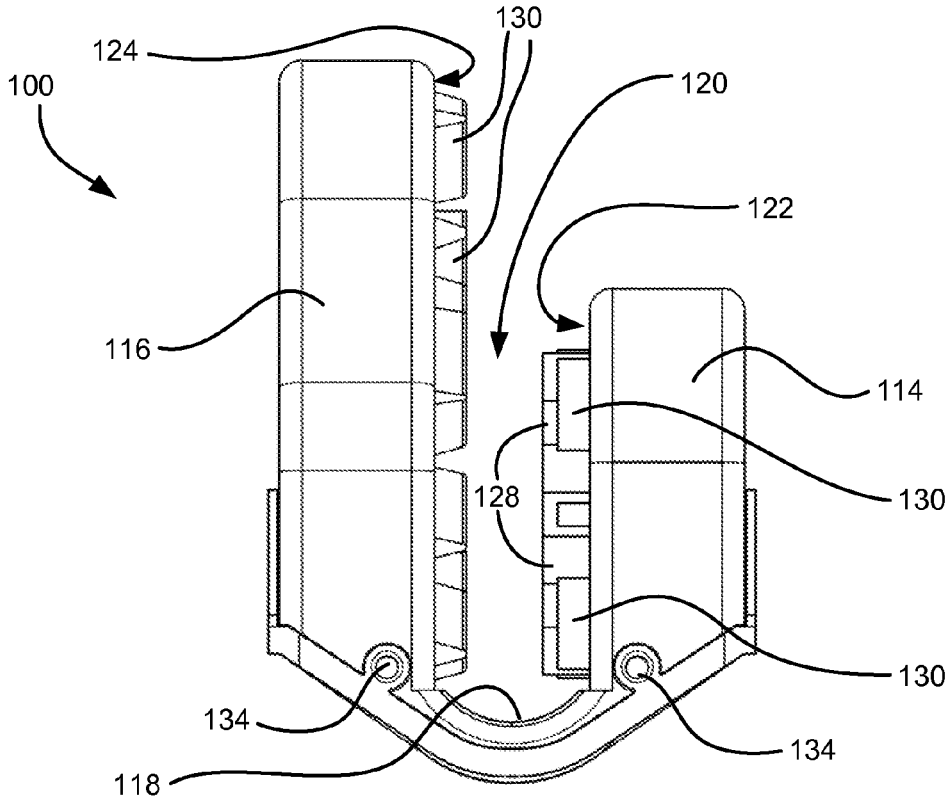
FIG. 10 is another side view of the apparatus shown in FIG. 6 in accordance with an embodiment of the present disclosure.

Exterior wall 122 of the first pocket 114 includes a plurality of bristles 128 dispersed among the plurality of protrusions 130. Each bristle portion 128 may include a plurality of individual strands of bristles or may be a solid cylindrical bristle. The bristles 128 are deformable to enter and clean the grooves of a golf club head. The bristles 128 extend from the wall 122 at a height greater than the protrusions 130, as can be seen in FIGS. 7, 8 and 10. Here, the protrusions 130 are configured at a lower height than the bristles 128 to protect the bristles from being detached from the wall 122 in use, e.g., from excessive force applied by the user. The difference in height between the bristles 128 and protrusions 130 allow the unattached ends of the bristles to enter and clean the grooves 44 of the club head 40. The protrusions 130 of the wall 122 prevent stress at the end of the bristle that is attached to the wall 122 by preventing the protrusions on wall 124 from making contact with wall 122. Other bristle shapes are contemplated to be within the scope of the present disclosure. Although a plurality of bristles 128 are shown, other abrasive materials or surfaces (e.g., brushes) are also contemplated to be within the scope of the teachings of the present disclosure.

Furthermore, it is to be appreciated that both walls 122 and 124 may include a plurality of bristles 128 dispersed among the plurality of protrusions 130. In one embodiment, the bristles may be disposed on the walls 122, 124 to align with each other when the first and second pockets 114, 116 are brought together. In another embodiment, the bristles 128 disposed on each wall may be placed to be offset from each other when the first and second pockets 114, 116 are brought together, i.e., the bristles on opposing walls will not contact each other when the pockets 114, 116 are squeezed together.

The individual circular bristle portions 128 may be fixed to wall 122 individually or may be fixed to a substrate which is then coupled to exterior wall 122 by a conventional adhering process. In another embodiment, the exterior walls 122, 124 may be provided with an exchangeable component. For example, the plurality of bristles 128 may be provided on a substrate which can be removed and replaced with a different substrate that may have a different abrasive surface or different size bristles disposed thereon to accommodate different tasks. Likewise, the protrusions 130 may be provided on a removable substrate which can be replaced with other components. This embodiment will facilitate replacing of the plurality of bristles 128 when the original bristles are worn.

Figure 11:
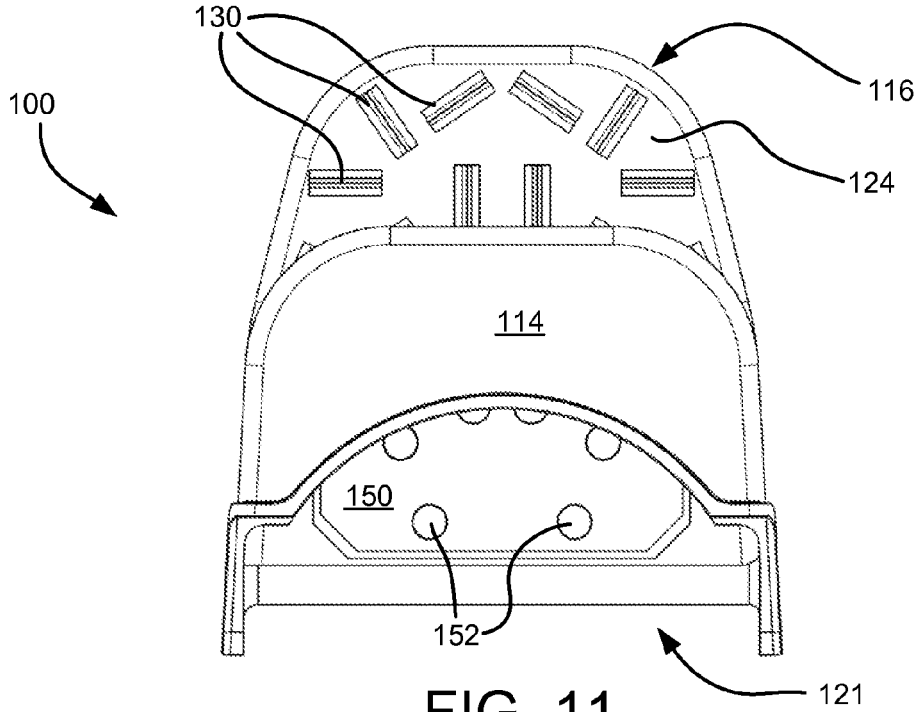
FIG. 11 is a front view of the apparatus shown in FIG. 6 in accordance with an embodiment of the present disclosure.

Referring to FIG. 11, the removable component may be removably coupled to the apparatus via opening 121 in one of the first or second pockets 114, 116. Interior wall 150 of the first pocket 114 may be formed with a plurality of apertures 152. The apertures 152 will be positioned as to not interfere with any of the protrusion 130 disposed on the exterior wall 124. A substrate (not shown) formed with a plurality of bristles 128 will be inserted in opening 121 and aligned with interior wall 150 so that the bristles 128 will pass through the apertures 152 and extend pas the protrusions on the wall 122. The substrate may then be coupled to the interior 150 or a sealing means may be provided over the substrate to lock the substrate in. It is to be appreciated that the substrate may be permanently fixed to the body of the apparatus or temporarily coupled to allow the substrate and attached bristles to be replaced.

While the disclosure has been shown and described with reference to certain preferred embodiments thereof, it will be understood by those skilled in the art that various changes in form and detail may be made therein without departing from the spirit and scope of the disclosure.

Furthermore, although the foregoing text sets forth a detailed description of numerous embodiments, it should be understood that the legal scope of the invention is defined by the words of the claims set forth at the end of this patent. The detailed description is to be construed as exemplary only and does not describe every possible embodiment, as describing every possible embodiment would be impractical, if not impossible. One could implement numerous alternate embodiments, using either current technology or technology developed after the filing date of this patent, which would still fall within the scope of the claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

What is claimed is:

1. An apparatus for cleaning a golf club comprising:

a substantially symmetrical body having a first pocket opposite a second pocket for accepting fingers or a thumb of a user, the first and second pockets being flexibly coupled by a hinge portion and defining a first opening there between for receiving a head of a golf club;

a second opening being defined by the opening ends of the first and second pockets and is configured for receiving a hand of the user;

the first pocket includes a first exterior wall which faces inward toward the first opening and the second pocket, the first exterior wall including a first plurality of protrusions and a plurality of bristles, wherein the bristles are of a greater height than the protrusions, and the second pocket includes a second exterior wall which faces inward toward the first opening and the first pocket, the second exterior wall including a second plurality of protrusions.

2. The apparatus of claim 1, wherein the first and second plurality of protrusions are of substantially the same height.

3. The apparatus of claim 2, wherein the first and second plurality of protrusions are rigid.

4. The apparatus of claim 3, wherein the first and second plurality of protrusions are removably coupled to a respective exterior wall.

5. The apparatus of claim 3, wherein the bristles are deformable.

6. The apparatus of claim 5, wherein the bristles are removably coupled to the first exterior wall.

7. The apparatus of claim 5, wherein the bristles include a plurality of individual strands of bristles.

8. The apparatus of claim 7, wherein the plurality of individual strands of bristles are coupled to a substrate and the substrate being removably coupled to the first exterior wall.

9. The apparatus of claim 5, wherein the first plurality of protrusions are configured to prevent the second plurality of protrusions from contacting the first exterior wall.

10. The apparatus of claim 1, wherein the first and second pockets and hinge portion are of a unitary construction.

11. The apparatus of claim 1, further comprising an aperture disposed adjacent the second opening for tethering the body to an object.

* * * * *